US011258205B2

(12) United States Patent
De Geest et al.

(10) Patent No.: US 11,258,205 B2
(45) Date of Patent: Feb. 22, 2022

(54) HIGH PERFORMANCE CONNECTOR

(71) Applicant: Amphenol FCI Asia Pte. Ltd., Singapore (SG)

(72) Inventors: Jan De Geest, Wetteren (BE); Stefaan Sercu, Wuustwezel (BE)

(73) Assignee: Amphenol FCI Asia Pte. Ltd., Singapore (SG)

( * ) Notice: Subject to any disclaimer, the term of this patent is extended or adjusted under 35 U.S.C. 154(b) by 0 days.

(21) Appl. No.: 16/569,497

(22) Filed: Sep. 12, 2019

(65) Prior Publication Data

US 2020/0006897 A1 Jan. 2, 2020

Related U.S. Application Data

(63) Continuation of application No. 14/763,243, filed as application No. PCT/IB2013/000364 on Jan. 24, 2013, now Pat. No. 10,418,753.

(51) Int. Cl.

| | |
|---|---|
| ***H01R 13/648*** | (2006.01) |
| ***H01R 13/6466*** | (2011.01) |
| ***H01R 13/6587*** | (2011.01) |
| ***H01R 13/6471*** | (2011.01) |
| ***H01R 12/71*** | (2011.01) |

(52) U.S. Cl.

CPC ..... *H01R 13/6466* (2013.01); *H01R 12/71* (2013.01); *H01R 13/6471* (2013.01); *H01R 13/6587* (2013.01)

(58) Field of Classification Search

CPC ..... H01R 13/65802; H01R 23/688; H01R 23/6873; H01R 23/7073; H01R 12/57; H01R 13/6466; H01R 13/6471; H01R 13/6587; H01R 12/71

USPC ..... 439/79, 83, 607.01, 607.07, 607.09, 439/607.1, 607.11, 607.13, 607.32, 660

See application file for complete search history.

(56) References Cited

U.S. PATENT DOCUMENTS

| | | | | |
|---|---|---|---|---|
| 5,895,278 | A | 4/1999 | Humphrey | |
| 6,471,548 | B2 | 10/2002 | Bertoncini et al. | |
| 6,692,272 | B2 | 2/2004 | Lemke et al. | |
| 6,976,886 | B2 | 12/2005 | Winings et al. | |
| 7,094,102 | B2 * | 8/2006 | Cohen | H05K 7/1445 439/607.08 |
| 7,108,556 | B2 | 9/2006 | Cohen et al. | |

(Continued)

FOREIGN PATENT DOCUMENTS

WO WO 2013/075693 A1 5/2013

OTHER PUBLICATIONS

European Communication for European Application No. 13724618.7 dated Mar. 10, 2017.

*Primary Examiner* — Thanh Tam T Le

(74) *Attorney, Agent, or Firm* — Wolf, Greenfield & Sacks, P.C.

(57) ABSTRACT

A connector (103) is provided having a plurality of leads generally arranged in columns extending substantially parallel each other in a column direction (C) and being adjacent each other in a row direction (R). At least one first column comprises at least one first pair of single leads (S) substantially parallel each other in a first pair direction (P) to form a first differential pair. In at least a portion of the connector the first pair direction extends at an acute angle (a) to the column direction. Further, an assembly, and a circuit board are provided.

28 Claims, 9 Drawing Sheets

(56) References Cited

U.S. PATENT DOCUMENTS

| | | | | |
|---|---|---|---|---|
| 7,182,643 | B2 | 2/2007 | Winings et al. | |
| 7,381,092 | B2 * | 6/2008 | Nakada | H01R 13/514 439/607.1 |
| 7,467,955 | B2 | 12/2008 | Raistrick et al. | |
| 7,500,871 | B2 * | 3/2009 | Minich | H01R 12/727 439/544 |
| 7,651,373 | B2 | 1/2010 | Knaub | |
| 7,674,133 | B2 * | 3/2010 | Fogg | H01R 13/6587 439/607.07 |
| 7,837,505 | B2 | 11/2010 | Minich | |
| 7,914,305 | B2 | 3/2011 | Amleshi | |
| 8,215,968 | B2 * | 7/2012 | Cartier | H01R 13/6474 439/83 |
| 8,251,745 | B2 | 8/2012 | Johnescu | |
| 8,444,436 | B1 | 5/2013 | Cohen | |
| 8,475,183 | B2 | 7/2013 | Chien | |
| 8,535,065 | B2 | 9/2013 | Costello | |
| 8,556,657 | B1 | 10/2013 | Nichols | |
| 8,905,785 | B2 | 12/2014 | Johnescu | |
| 10,418,753 | B2 | 9/2019 | De Geest et al. | |
| 2006/0024983 | A1 | 2/2006 | Cohen et al. | |
| 2008/0045079 | A1 | 2/2008 | Minich et al. | |
| 2009/0311908 | A1 | 12/2009 | Fogg et al. | |
| 2011/0275249 | A1 | 11/2011 | Cartier et al. | |
| 2012/0202380 | A1 | 8/2012 | Lappoehn | |
| 2015/0372427 | A1 | 12/2015 | De Geest et al. | |

* cited by examiner

HIGH PERFORMANCE CONNECTOR

CROSS REFERENCE TO RELATED APPLICATIONS

This patent application is a continuation of U.S. patent application Ser. No. 14/763,243, now U.S. Pat. No. 10,418,753, filed Jul. 24, 2015 and entitled "Connector Assembly," which is hereby incorporated herein by reference in its entirety. U.S. patent application Ser. No. 14/763,243 is the National Stage of International Application No. PCT/IB2013/000364, filed Jan. 24, 2013 and entitled "Connector Assembly," which is hereby incorporated herein by reference in its entirety.

TECHNICAL FIELD

The present disclosure relates to the field of electrical connections, in particular for high-speed signal transmission.

BACKGROUND

A well-known technology for high-speed signal transmission is differential signal transmission. A connector and/or a circuit board may therefore comprise plural leads arranged in differential signal pairs. However, it has been found that differential signal pairs exhibit cross talk, in particular pair-cross talk, which reduces signal integrity. Obviously, this is undesired. The cross talk noise tends to increase with proximity between adjacent differential signal pairs and with increasing signal speed.

However, there is an ongoing trend for smaller and faster electronic devices and power reduction for signals. Cross talk noise is thus set to become an increasing problem.

Consequently, improved connectors are desired to address the above conflicting demands.

SUMMARY

Herewith, an assembly according to claim 1 is provided. The connector comprises a plurality of leads generally arranged in columns extending substantially parallel each other in a column direction and being adjacent each other in a row direction. This facilitates its design and manufacturing. E.g., it facilitates incorporation of the connector in a regular grid and/or combination with other connectors or devices. At least one first column comprises at least one first pair of signal leads substantially parallel each other in a first pair direction to form a first differential pair. This allows differential signal transmission. Parallelism of the leads assists reducing surface area spanned between the leads and it may reduce different noise influences on the individual leads, both improving signal integrity. In at least a portion of the connector the first pair direction extends at an acute angle $\alpha$ to the column direction. Thus, the surface area spanned by the first differential pair in the connector portion under concern is arranged at the first pair direction. Hence, the effective differential pair surface area perpendicular to the column direction is reduced to about cos a, so that picking up of noise by the differential pair from signals in adjacent columns is reduced correspondingly.

The connector may comprise a plurality of such differential pairs arranged in a pair direction at an acute angle to the column direction, providing improved performance for these pairs.

In the case of claim 2, mutual inductance between adjacent differential pairs and thus pair cross talk in the adjacent columns is reduced. The pairs may be arranged in columnar fashion. Effectively, the first and second pairs may be staggered, considered in a direction substantially perpendicular to the pair direction, further reducing overlap of the surface areas of the pairs.

In the connector of claim 3, the mutual inductance between the first and second differential pairs is effectively reduced and may be minimal. Thus, the pair cross talk between the first and second differential pairs may be minimal.

In an alternative, in at least a portion of the connector in adjacent first and second columns the first and second pair directions are generally opposite, preferably substantially perpendicular to each other. In such case, the differential signal pairs may be arranged adjacent each other with little to no mutual inductance and little to no cross talk effect on each other. In a modular connector, this may require different modules, possibly arranged alternating. Potential increased costs may be outweighed by improved signal integrity and/or performance.

In the connector of claim 4, adjacent differential pairs within one column are shielded from each other by the ground leads, improving signal integrity.

In the connector of claim 5, differential pairs in adjacent columns are shielded from each other by the shields, improving signal integrity.

In the connector of claim 6, the shield contacts may be arranged to account for impedance and/or shielding differences for the signal leads, in particular at or near contact portions of the leads. Shield contacts extending outside the plane on opposite sides allows arranging the contacts appropriately, in particular symmetrically with respect to the signal leads in columns on opposite sides of the shields. Further, contact and/or conductor layout of a further object connected to the connector, e.g. a circuit board or a counterconnector may be facilitated and/or improved.

The connector of claim 7 facilitates manufacturing the connector and further objects such as a counterconnector or a circuit board to be connected to the connector, in particular with respect to tracing leads and/or determining contact pitches. Also, mechanical forces may be distributed evenly. Also, (cross talk) noise effects of leads, in particular of differential signals pairs, may be substantially predictable and/or substantially constant for different pairs in the connector.

The connector of claim 8 facilitates manufacturing the connector from modules that may be manufactured cost effectively. Further, different pinouts and/or sizes for the connector may be provided by selecting different modules. The connector may comprise substantially identical or different modules, possibly a number of modules which are mirror-images of each other. Use of identical modules generally reduces manufacturing costs.

As defined in claim 9, one or more modules may comprise sub-modules, e.g. to provide a certain pitch.

Shields may be arranged between modules. The modules may be mounted in a housing to form the connector, which may have a generally rectangular shape due to the row of modules.

In another aspect the assembly of claim 10 is provided. The connector may be connected, preferably releasably, with the counterconnector e.g. for interconnecting different devices. The connector may also be connected, possibly releasably, with the circuit board. The contacts may comprise press-fit contacts, solder contacts and/or other contacts, e.g. surface mount contacts such as a ball grid array and/or a pin grid array.

In the assembly of claim 11, the mated contact and counter contact provide a reliable electrical contact with relatively little material. At least one of the contacts may be a tuning fork contact. The orientation of the elongated shape of the contacted contact and counter contact along the differential pair direction, e.g. having an effective angle between the pair direction and the elongated shape direction of less than about 45 degrees, retains or even enhances the differential pair direction in that mating portion of the (counter-)contacts. In the mating portion the open area between the conductive masses for each lead of the differential pair concerned may be reduced, reducing noise pick-up of the pair. Hence, the cross talk properties may be substantially constant or locally even improved along the signal leads. In an embodiment wherein the elongated shape of the conductive mass is rotated against the pair direction, e.g. having an effective angle between the pair direction and the elongated shape direction of more than about 45 degrees, a relatively large separation between the leads of the pairs in the mating portions may be achieved, providing electrical and mechanical robustness. Further, capacitive coupling between the leads of one differential pair in the mating portion may be increased, facilitating providing a desired impedance in the mating portion.

The counterconnector may advantageously also be a connector as specified before.

In the assembly of claim 12, tracing of leads in or on the circuit board and/or allocation of real estate on the board may be facilitated. Also, mechanical strength of the board may be improved. Also, thermal management of the board during soldering and/or solder reflow processes may be improved. Also, noise and/or impedance for different leads and/or differential pairs may be substantially similar or constant in different leads in or on the board.

Also, in the assembly of claim 13, the circuit board may comprise a footprint for accommodating a connector having a substantially rectangular or elongated shape with respect to column and row directions perpendicular to each other, and having differential pair contacts arranged generally in lines at an acute angle to the column and row directions.

In the circuit board of claim 14, enlarged ground contacts are provided which facilitate connecting, e.g. receiving large contacts and/or plural contacts of leads and/or shields. This also allows for significant amounts of shielding material and/or large tolerances. Further, in case of use with plural connector contacts contacted to one enlarged ground contact, ground loops are prevented.

In another aspect, an assembly is provided comprising a connector comprising a plurality of leads comprising differential signal pairs, the leads being arranged in first columns, the assembly comprising a second object connected or connectable with the connector, the second object comprising a plurality of contacts for contacting the connector contacts, being generally arranged in second columns, characterised in that the first and second columns are arranged at an acute angle to each other. At least some of the first columns may be provided by lead modules or lead frame assemblies in insulating housings.

BRIEF DESCRIPTION OF THE DRAWINGS

The above-described aspects will hereafter be more explained with further details and benefits with reference to the drawings showing an embodiment of the invention by way of example.

DETAILED DESCRIPTION OF EMBODIMENTS

Figure 1:
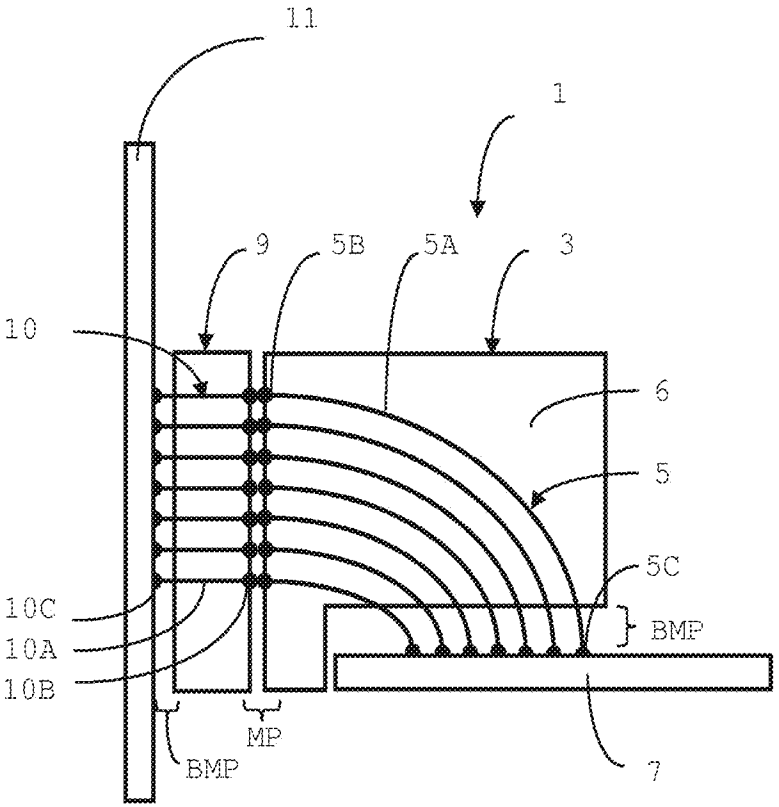
FIG. 1 shows a connector connected to a first circuit board on one side and connected via a header to a second circuit-board on another side.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified.

FIG. 1 shows an assembly 1 comprising a connector 3 comprising a plurality of leads 5 in an insulating material 6. The connector is connected to a first circuit board 7 on one side and on another side to a counterconnector 9 in the form of a header 9 having leads 10. On the opposite side from the connector 3, the header 9 is connected to a second circuit board 11. All leads 5, 10 comprise a lead portion 5A, 10A, and first contact portions 5B, 10B, on one end for contacting an associated lead 10, 5 of the mated connector 9, 3 in a mating portion MP. The leads 5, 10, further comprise second contact portions 5C, 10C, on their opposite end for contacting a respective further object to be contacted, here the first and second circuit boards 7 and 11, respectively. The mating contacts 5B, 10B may be partly or fully enveloped in dielectric housing material of the connector and/or counterconnector (not shown), when mated. Board connectors 5C, 10C may be generally exposed from connector housing material in respective board mounting portions BMP. The shown connector 3 is a right-angle connector, but the disclosure and the concepts disclosed herein are not limited to such connector and any angle including a straight mezzanine connector may be provided.

Figure 2:
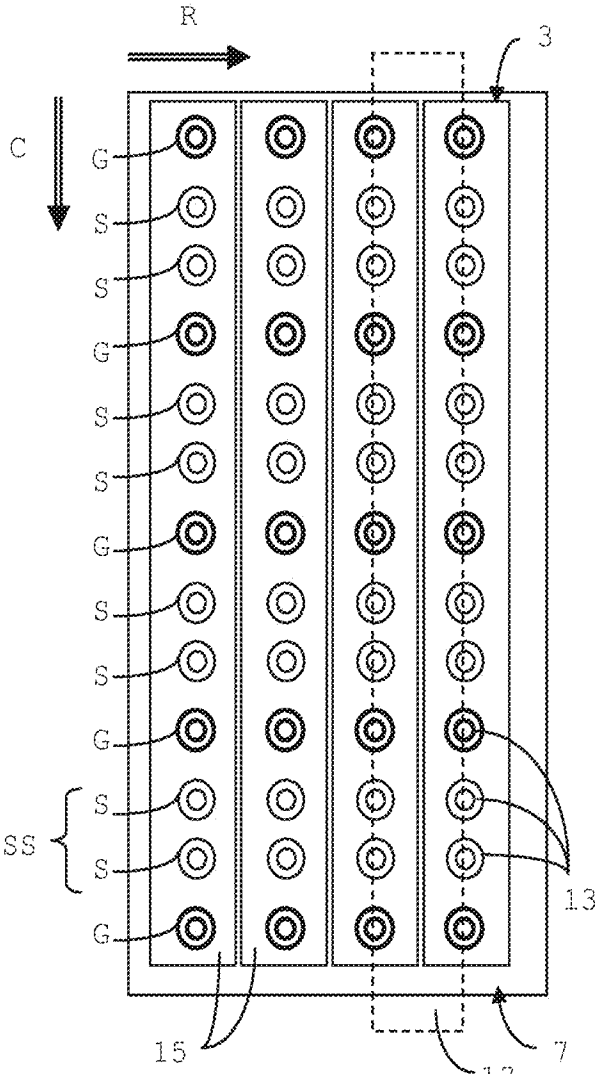

FIG. 2 shows the footprint of a conventional connector 3 on a portion of the first circuit board 7. The circuit board 7 comprises a plurality of contacts generally indicated with 13 arranged in a regular grid pattern of columns in a column direction C and rows in a row direction R substantially perpendicular to the column direction C. Each contact 13 may comprise a surface mount contact and/or a (plated) via extending into the circuit board 7.

Indicated in FIG. 2 is that the connector 3 is of modular construction comprising a plurality of lead modules 15 having a plurality of leads 5 in a dielectric carrier. To form the connector 3 the modules 15 are attached to each other, e.g. being received in an insulating housing (not shown). The modules 15 provide the columnar arrangement. Here, the contacts 13 correspond to the positions of the leads 5 in the connector 3, which leads extend substantially perpendicular to the shown plane of FIG. 2, on a perpendicular scale sufficiently small that the curvature of the right angle is not discernible. In other words, the pattern shown in FIG. 2 corresponds to a cross sectional plane substantially perpendicular to the direction of the leads 5 at that cross section. Such pattern may be substantially constant throughout the connector 3, but there may also be portions in which the shape and/or separation of the leads 5 may vary in the column direction C and/or different amounts of dielectric material of the carrier may be provided, e.g. for reasons of impedance matching.

In FIG. 2 a column 17 is indicated in phantom, defined by the contacts 13 on the circuit board. The column 17 is parallel to and offset from the columns 15 of the connector 3. In such column 17 traces on the circuit board may be arranged substantially without interference of and/or by the contacts 13.

In FIG. 2, all modules 15 are substantially identical. Within each column, the leads 5 are arranged generally in a plane in the column direction c in a regular repetitive ground—signal S—signal S—ground G pattern. In significant portions of the connector, at least the signal leads S extend substantially parallel to each other in a first pair direction along the column direction C and form a first differential pair SS. In a curved section of the connector 3 this may result in curves with different effective radii. In the column direction C, the differential signal pairs SS are separated by a ground lead G, which may extend substantially parallel to the signal leads. Here and in the following, ground leads or ground contacts are marked in heavy lines, and signal leads or contacts are marked in thin lines. The pairs SS of signal leads S in adjacent modules 15 are adjacent each other. Hence, surface area spanned between the leads of the differential pairs SS in adjacent columns 15 face each other, leading to the pairs SS having a large mutual inductance. Thus, pair cross talk between adjacent differential pairs SS in adjacent columns 15 may be a problem.

Figure 3:
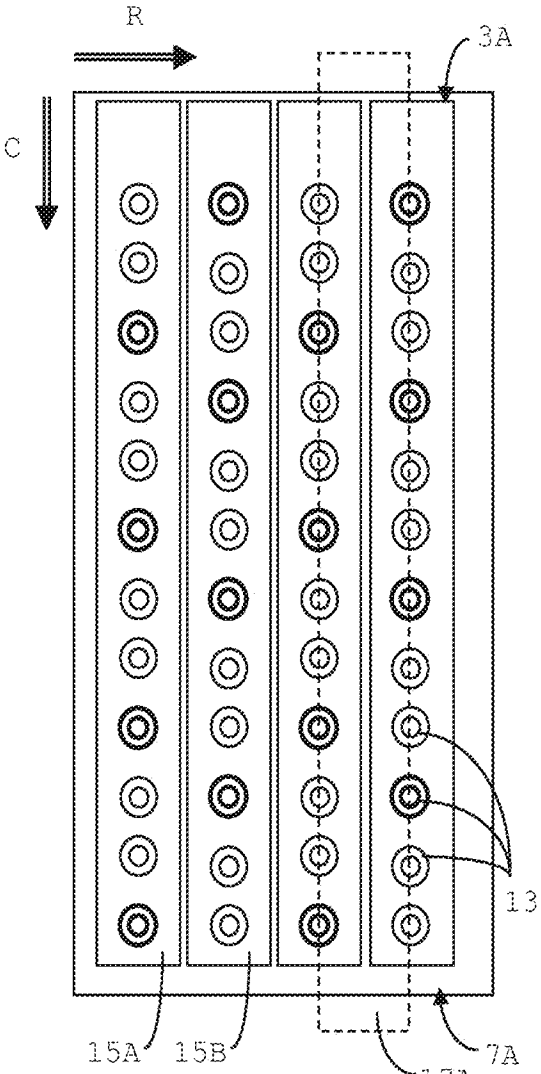
FIGS. 2 and 3 indicate footprints of known assemblies.

FIG. 3 shows a known improvement over FIG. 2 in an assembly 1A of a connector 3A and a circuit board 7A comparable to the assembly 1 of FIG. 2. Here, the connector 3A comprises alternating modules 15A, 15B providing columns in which the ground leads G and signal leads S are arranged differently. As a result, the differential pairs SS of this connector 3A are arranged in a staggered manner, reducing overlap between differential pairs in adjacent columns. On the circuit board 7A comprises columns 17A parallel to and offset from the columns formed by the modules 15A, 15B of the connector 3A. This arrangement shows less cross talk than that of FIG. 2. However, the arrangement of FIG. 3 requires two different modules 15A, 15B to assemble the connector 3A, which may increase costs with respect to the assembly of FIG. 2.

Embodiments of presently disclosed improvements are explained hereafter with reference to FIGS. 4-18, adopting the reference numbers used before but increased by 100, 200, etc.

Figure 4:
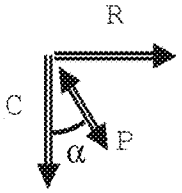
Figure 4:
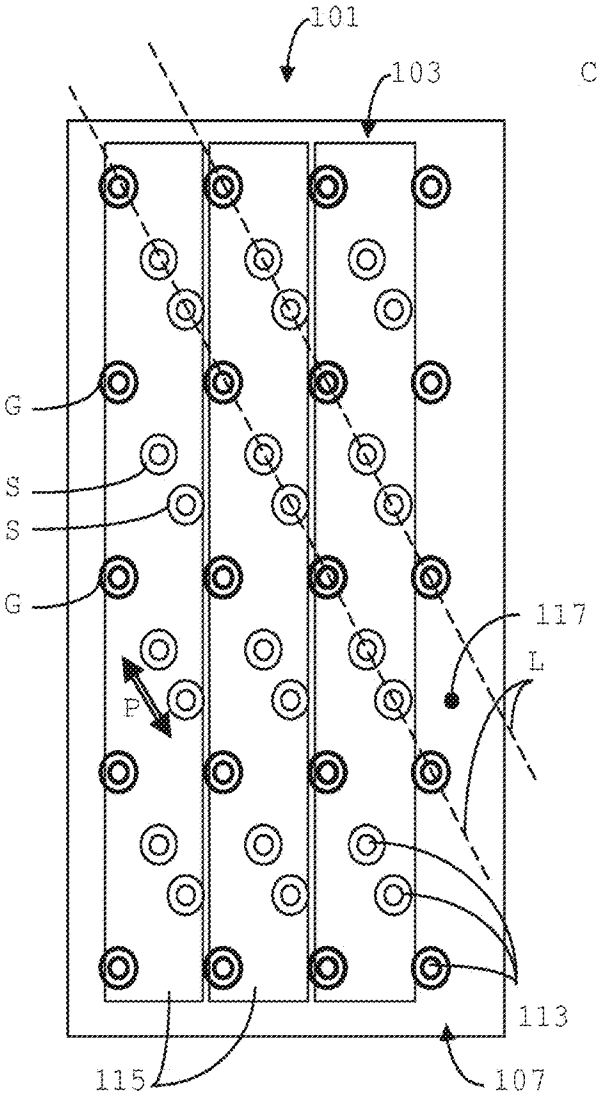

FIG. 4 shows, similar to FIGS. 2-3, the footprint of an improved assembly 101 with a connector 103 of the general type of FIGS. 2 and 3 on a connector portion of the first circuit board 107. The connector 103 comprises a plurality of lead modules 115 providing columns extending in the column direction C and being adjacent each other in the row direction R. Each module 115 comprises ground leads 105 (G) and signal leads 105 (S) arranged in the column provided by the module 115. In each module 115 the signal leads S are pairwise substantially parallel each other and lie adjacent each other in a pair direction P, forming differential pairs SS at an acute angle $\alpha$ to the column direction C. In FIG. 4, the ground leads G extend substantially parallel to the signal leads S and lie adjacent, in the pair direction P, to the signal leads S of an adjacent differential pair SS in the module. In the column direction C of the connector 103, the differential pairs SS are separated by a ground lead G.

In FIG. 4, adjacent modules 115 are substantially identical, and the pair directions P of differential pairs SS in adjacent columns are generally parallel to each other. The signal and ground leads S, G, are arranged in each module 115 such that in the shown contact portion the signal leads S and the ground leads G are arranged along substantially straight lines L in the pair direction p spanning plural adjacent columns 115. Thus, the lines L provide lines of differential pairs SS separated by a ground lead G, here extending substantially parallel to each other. In adjacent lines L the differential pairs SS are arranged in a staggered manner. Thus, in the embodiment of FIG. 4, a staggered arrangement of adjacent differential signal pairs, providing a low pair-to-pair cross talk, is provided with substantially identical modules 115 in the connector 103, which reduces its manufacturing costs. The lines L provide substantially straight columns 117 on the circuit board 107, again facilitating manufacturing and/or tracing, etc.

The separation of the signal leads S forming a differential pair SS within one module and the separation between differential pairs, as well as the amount of staggering in adjacent modules may be adjusted to desired arrangements and/or values in this manner using substantially identical modules 115.

The lines L provide substantially straight columns 117 on the circuit board 107, and the contacts 113 are arranged in a regular grid-like array having columns and rows at perpendicular angles. The columns (and rows) of the circuit board 107 extend at the acute angle $\alpha$ to the columns (and rows) of the connector 103, wherein differential signal pairs SS in the columns 117 on the circuit board 107 correspond to differential signal pairs SS of different connector columns. Such regular contact arrangement may, inter alia, facilitate routing traces in and/or on the circuit board 107, and it may facilitate manufacture of and/or modelling of the circuit board 107.

The modules 115 may be manufactured as single objects, e.g. by overmoulding a lead frame array wherein the leads are cut, e.g. stamped, from a blank and have been formed, e.g. bent, out of the blank to different planes, and/or by overmoulding leads formed from a plurality of blanks. Alternatively, a module may comprise a number of sub-modules, each comprising a number of leads in an insulating housing which are combined to provide a module 115. This may facilitate manufacturing of each sub-module, reducing manufacturing costs for the connector 103 as a whole.

Figure 5:
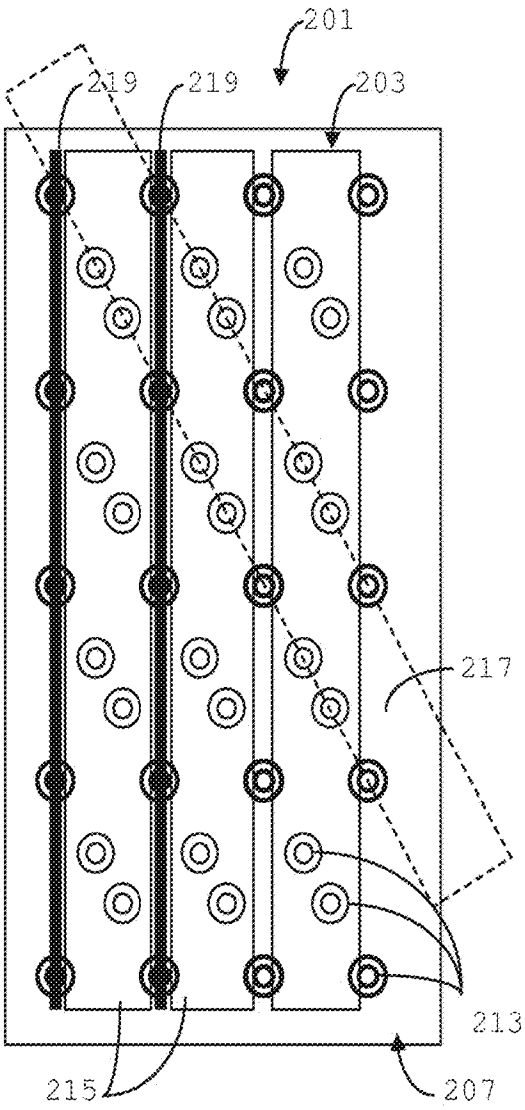
FIGS. 4-9 indicate conductor arrangements of improved assemblies.

FIG. 5 shows an assembly 201 being a further embodiment. In this assembly 201, the circuit board 217 is substantially identical to the board 117 of FIG. 4. Different from FIG. 4, in the connector 203 the modules 215 only comprise signal leads S, no ground leads. The relative arrangement of the signal leads S within the connector 203 is substantially identical to that of FIG. 4, with, at least in the cross section shown in FIG. 5, the pair directions P of differential signal pairs SS being at substantially identical angles $\alpha$ to the column direction C both within each module 215 and in each respective module 215. Further, the connector 203 comprises substantially plane shields 219 (only two shown) arranged adjacent and between the modules 215, shielding signal leads S in adjacent modules 215 from each other. The shields 219 are preferably formed corresponding to the modules 215, comprising a substantially solid shield body overlapping the dielectric housings 206 of the modules 215 and comprising shield contacts extending from the shield body for contacting the circuit board 207. Between the shield bodies, the differential signal pairs S in adjacent modules 215 are shielded from each other. Within each module, the separation between adjacent differential pairs SS and the rotation of their pair direction P with respect to the column direction C provide good separation against pair cross talk.

The shields 219 may comprise a rib, be embossed or comprise one or more otherwise structured portions to provide one or more grounded shielding portions, which shield portions may separate adjacent differential pairs SS within one column provided by a module 215, e.g. mimicking ground conductors G.

The shield contacts are mated to (the arrangement of) the contacts 213 of the circuit board 207, such that in the portion of the assembly 201 comprising the connector contacts 5C and the circuit board contacts 213, again lines of differential pairs SS separated by a ground contact G are provided with the differential pairs SS arranged in a staggered manner and forming substantially straight columns 217 on the circuit board 207. As in FIG. 4, in FIG. 5 a staggered arrangement of differential signal pairs is provided with substantially identical contact modules 215 (and shields 219).

Figure 6:
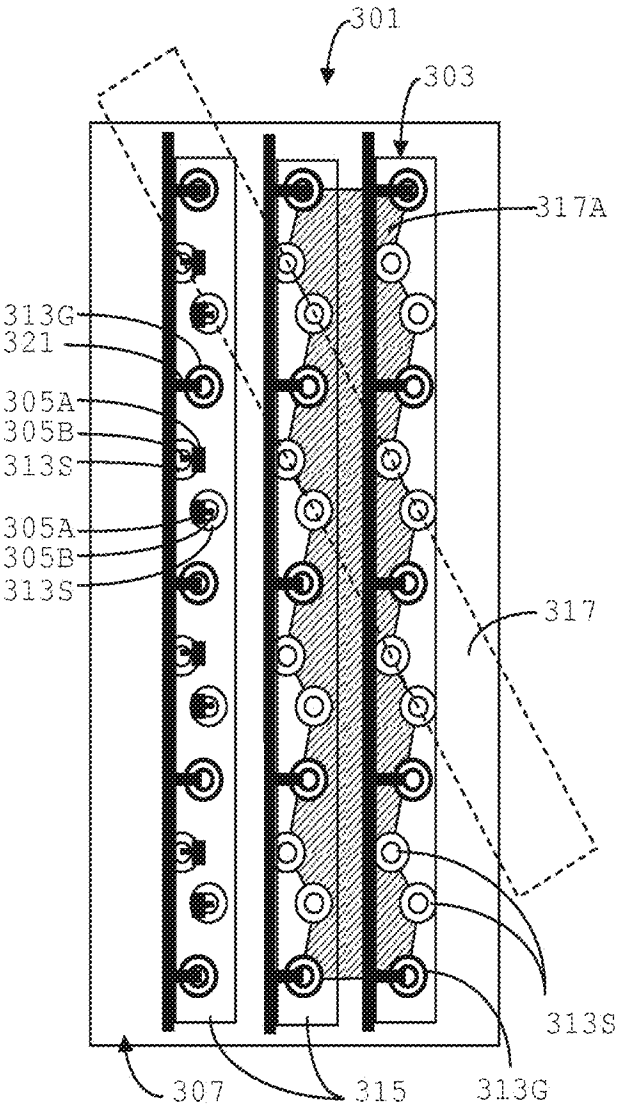

FIG. 6 shows an assembly 301 being a further embodiment. In the connector 303 of this embodiment, lead modules 315 comprise only leads 305 arranged as differential signal pairs SS. The lead portions 305A of each signal lead S extend substantially in a plane in the connector column direction C. As shown, for at least some signal leads 305 the board contact portion 305B extends outside of that plane and fits signal contacts 313S of the circuit board 307. Thus, the contacts 305B and 313S form portions of differential signal pairs SS with a pair direction P extending at an acute angle to the column direction C. The contacts 305B and 313S are again arranged in substantially straight lines spanning adjacent connector columns providing a staggered arrangement of differential pairs SS and providing substantially straight columns 317 on the circuit board 307.

Further, the shields 319 comprise shield contacts 321 extending from the plane of the shields and fitting associated contacts 313G on the circuit board 307. The contacts 313G are arranged such that in the straight columns 317 on the first circuit board 307 differential signal pairs SS in the column 317 are separated by a ground contact portion 321, 313G.

On the circuit board 307, one may also discern columns generally elongated but somewhat wavy columns 317A defined by the contacts 313S, 313G corresponding to the column direction C of the connector modules 315 (see hatched portion in FIG. 6). Tracing in and/or on the circuit board 307 may be arranged in such column 317 A too, which closely resembles the customary arrangement.

In a board mounting portion BMP where the leads 305 extend beyond the shields, the impedance and the pair cross talk shielding between differential signal pairs SS of adjacent connector columns is improved in the embodiment of FIG. 6. Also in the case of FIG. 6, a staggered arrangement of differential signal pairs SS in adjacent connector modules 315 may be provided with substantially identical modules 315 and shields 319.

As described for FIG. 5, the shields 319 may comprise ribs or other features extending at least partly into the columns provided by the modules 315 between adjacent differential signal pairs SS. Possibly, such extending shield portions may overlap a contact 313G so that the shield contacts 321 extend substantially straight from the shield to the associated contacts 313G.

In a variant to FIG. 6, not shown, one or more modules 315 may comprise ground leads overlapping contacts 313G and contacting these. In such case, a shield 319 may be obviated. In case a shield 319 is provided too, a shield contact 321 and a ground lead contact may both contact a single circuit board contact 313G. The circuit board 307 may be substantially identical.

Figure 7:
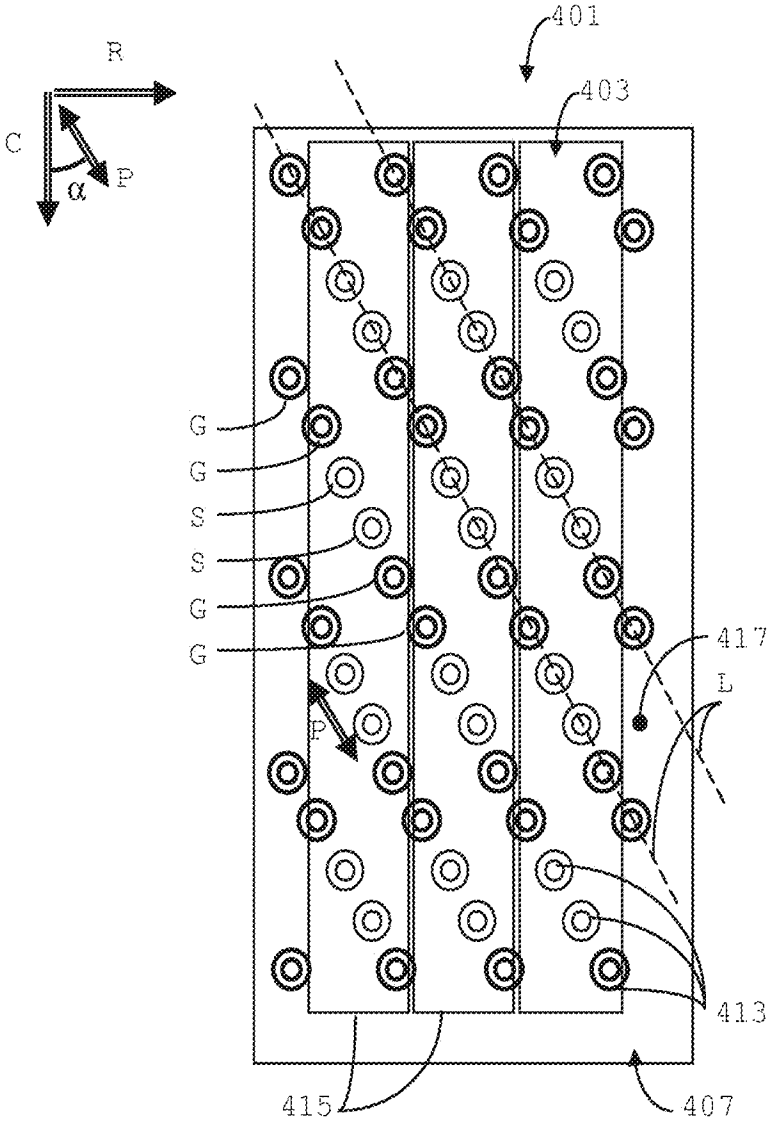
Figure 9:
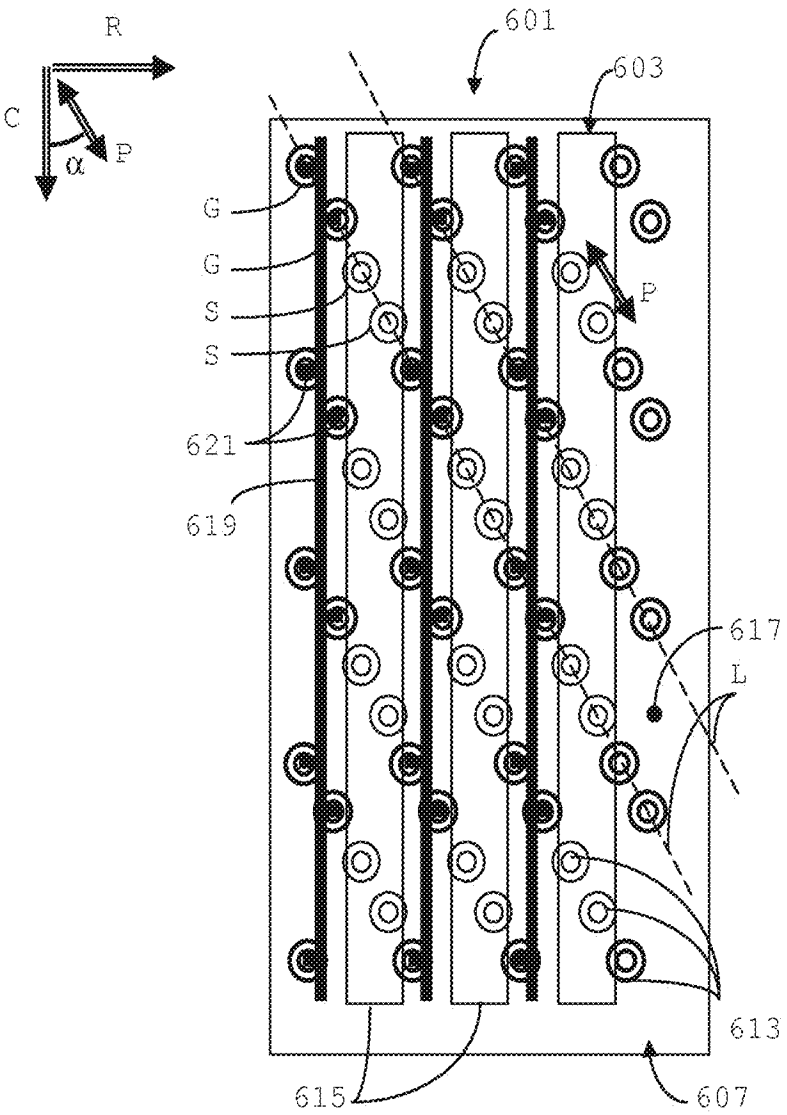
Figure 8:
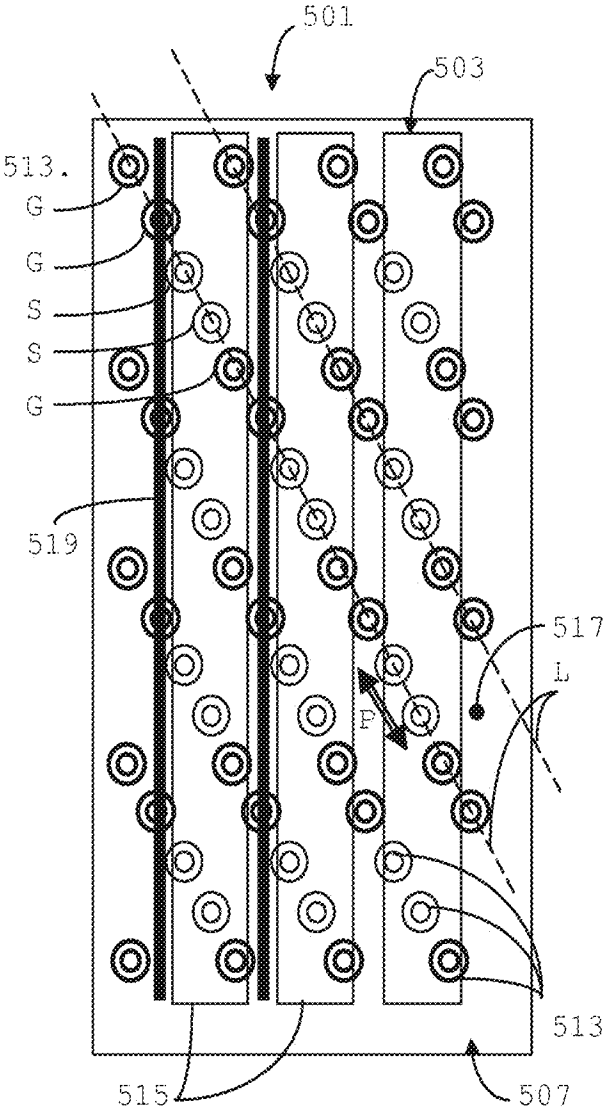
Figure 10A:
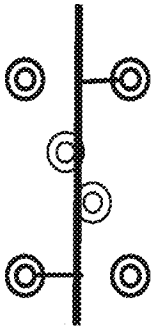
FIGS. 10A-10E indicate connections of grounds around a differential signal pair.
Figure 10B:
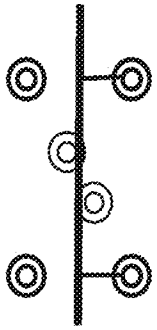
Figure 10C:
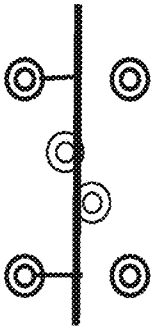
Figure 10D:
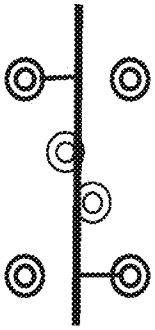
Figure 10E:
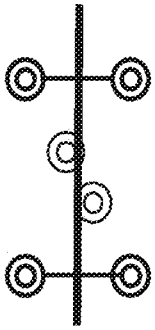

FIGS. 7-9 show assemblies 401, 501, 601, being further embodiments. In each of these embodiments, the first circuit board 407, 507, 607 comprise contacts 413, 513, 613 arranged in substantially straight lines L wherein differential signal pairs SS are arranged staggered between the lines and are separated by plural ground contacts G within the lines L. In each FIG. 7-9, the circuit boards 407, 507, 607 are substantially identical, with different connectors 403, 503, 603.

FIG. 7 shows that the connector 403 may comprise substantially identical modules 415 comprising, in at least a portion thereof, ground leads G pairwise surrounding differential signal pairs SS, effectively forming separate series of leads arranged as GSSG and extending diagonally with respect to the column direction C. Adjacent substantially identical modules 415 provide staggered differential signal pairs SS arranged in substantially straight lines L providing columns 417 arranged at an angle to the column direction C which may be used for tracing leads on the circuit board 407.

FIG. 8 shows that a number of circuit board ground contacts 513G may be used for contacting contacts of a shield 519, which may be substantially plane. The shield contacts 521 (not shown) may extend substantially in the plane of the shield 519. Other ground contact 513G may be used for a ground lead of a module 515 of the connector 503. Here, the ground contacts 513 of the circuit board 507 are used alternatingly.

FIG. 9 shows plane shields 619 comprising shield contacts 621 extending from the shields 619 in opposite directions and contacting adjacent ground contacts 613G in each line L.

It has been recognised that signal integrity of a differential signal may be improved when impedances of both signal leads are substantially identical. Thus, the arrangement of FIG. 7 facilitates providing symmetric impedances for the signal leads S making up a differential signal pair. In FIG. 8 all ground contacts 513 are interconnected by the shield 519, both shielding and defining a common potential across the contact lines L and along each module 515. In FIG. 9, symmetry of the impedance is improved as each differential signal pair SS is provided with a shield 619 on both opposite ends.

It has further been recognised that signal integrity of a differential signal may be significantly improved if adjacent grounds define substantially identical potentials. This is the case in FIG. 6.

Figure 11:
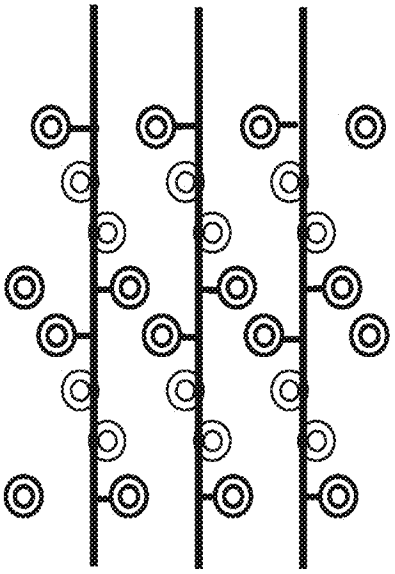
FIGS. 11-12 indicate different options for connecting grounds around plural differential signal pairs.
Figure 12:
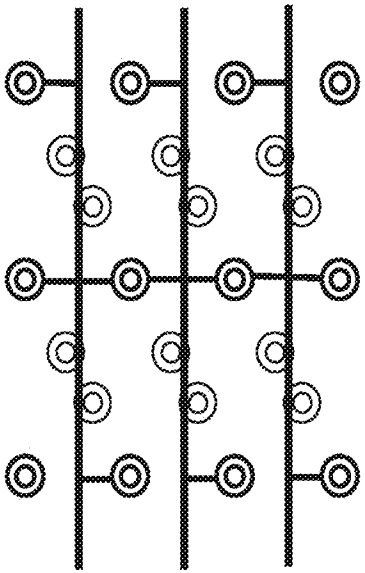

In FIGS. 10A-12 connection arrangements are shown (i.e., conductive channels, not necessarily physically formed the shown way) for improving definition of a common voltage on the grounds on opposite sides of rotated differential signal pairs SS. It is found to be important that the electrical path length between the ground leads G on opposite ends of a differential signal pair SS is reduced, and signal travelling times between the grounds G are minimised. The performance of the shown arrangements in terms of signal integrity and in particular in terms of pair cross talk between adjacent pairs improves going from FIG. 10A to FIG. 10E, with FIGS. 10B and 10C behaving substantially equal. FIG. 11 shows that implementing FIG. 10D is facilitated in the footprint arrangement of FIG. 7. The arrangement of FIG. 11 differs from FIG. 9 in the interconnection of grounds G for adjacent differential signal pairs SS (FIG. 9) or for a differential signal pair SS (FIG. 11) "enclosed" by grounds that are directly interconnected. FIG. 12 shows that repeating FIG. 10D may lead to FIG. 10E.

A connector comprising the layout of leads and/or shields according to FIG. 12 fits the circuit board 307 of FIG. 6.

To provide an assembly comprising a connector comprising plural modules and shields arranged between the modules, e.g. as in FIG. 5, 6, 8 or 9, adjacent shields may comprise shield contacts extending in opposite directions from the shield plane and, and both such contacts of adjacent shield may together contact the same circuit board contact (e.g. 313 of circuit board 307 of FIG. 6). Compared to each other, an assembly according to FIG. 11 facilitates manufacturing of the connector and an assembly according to FIG. 12 facilitates manufacturing of the circuit board as less contacts need be provided. FIG. 11 is particularly beneficial for solder pin or press-fit circuit board contacts. FIG. 12 particularly benefits surface mount contacts, e.g. solder contacts like a ball grid array.

Figure 13B:
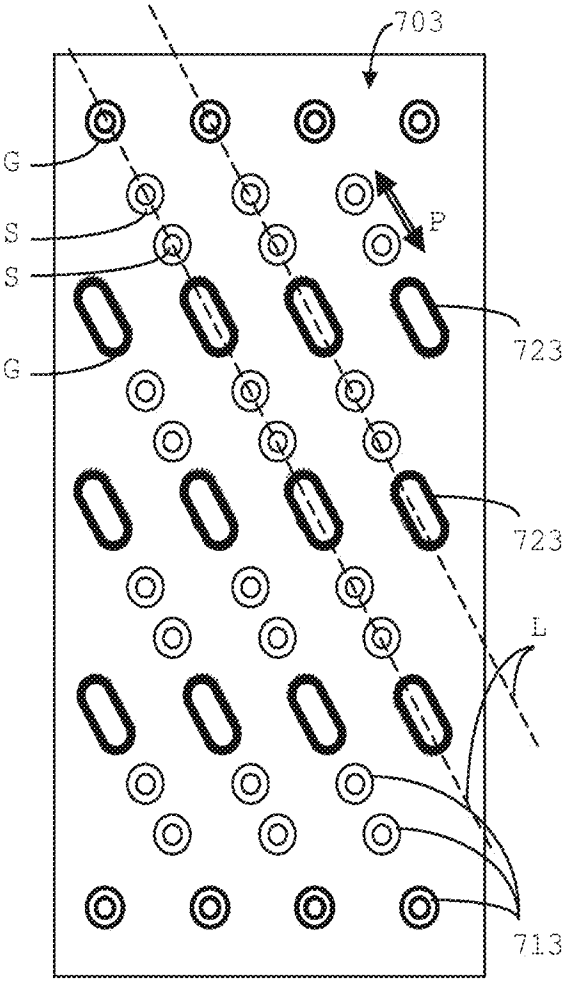
FIGS. 13A-13B indicate conductor arrangements of improved assemblies.
Figure 13A:
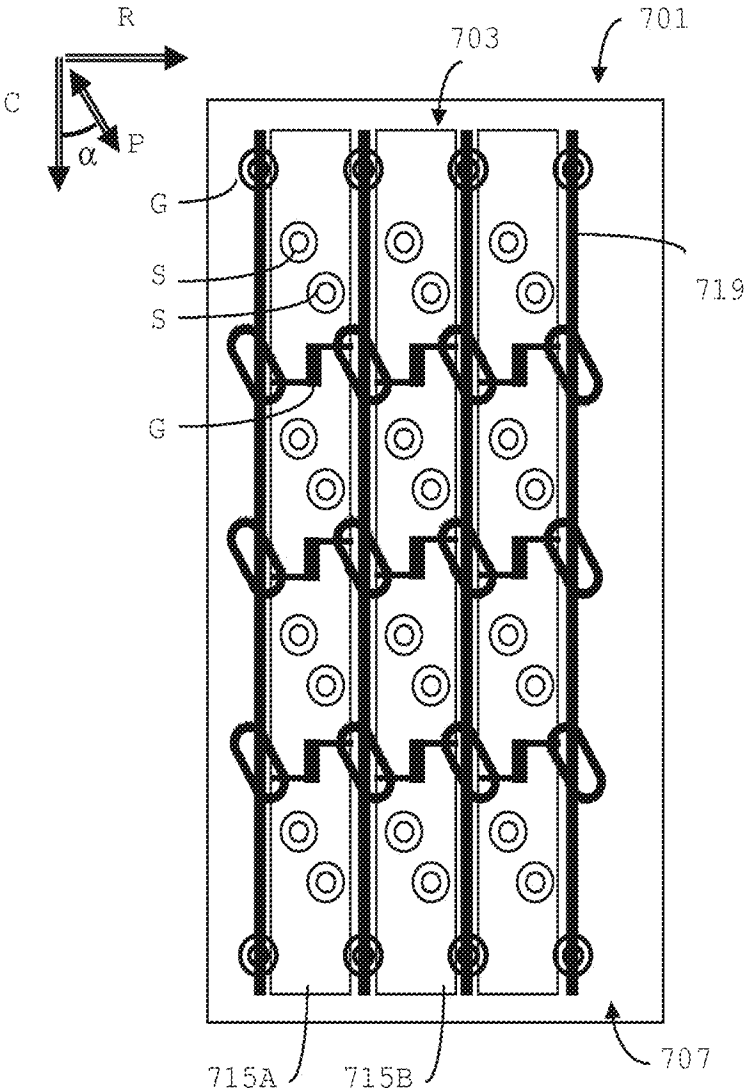

FIG. 13A indicates an embodiment of an assembly 701 and FIG. 13B indicates a circuit board 707 used in the assembly of FIG. 13A. In this case the circuit board 707 comprises elongated ground contacts 723 between adjacent differential signal pairs SS for contacting plural contacts from ground contacts and/or shield contacts of the connector, e.g. a connector 403, 503 or 603 according to FIGS. 7-9 or having an arrangement according to FIGS. 10A-12. Here, the elongated ground contacts 723 are comprised in a line L comprising plural differential pair contacts SS separated by the ground contacts G and they extend in the differential pair direction P along the line L. The elongated contacts 723 may e.g. comprise slotted holes for solder pin or press-fit contacts and/or solder islands for surface mount contacts.

The connector 703 shown in FIG. 13A comprises connector modules 715 and optional shields 719 between at least some modules 715. Each module 715 comprises signal leads S forming a differential pair SS at an acute angle to the column direction C and a ground lead G between adjacent differential pairs SS. The ground leads G are connected to elongated ground contacts 723 on opposite sides of the modules 715, except for the outermost ground leads G which are connected to a non-elongated ground contact 713. The shields 719 are also connected to the elongated contacts 723. The modules 715 may comprise further ground leads G on the top and/or bottom of the columns formed by the modules 715 (not shown). In the shown embodiment the shields 719 provide the ground conductors at that position. The ground contacts 713 on the top and/or bottom of each column C may be interconnected via traces on the circuit board and/or interconnections between the shields 719 in the connector (not shown). Compared to the, theoretically considered, best arrangements of FIGS. 10D-12, FIG. 13A provides only a small extension of the electrical path length between the ground leads G and provide a good approximation of the ideal behaviour.

Figure 15:
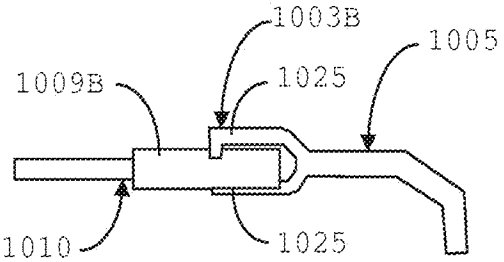
FIG. 15 is a side view of a contacted assembly of a contact and a counter contact.
Figure 14:
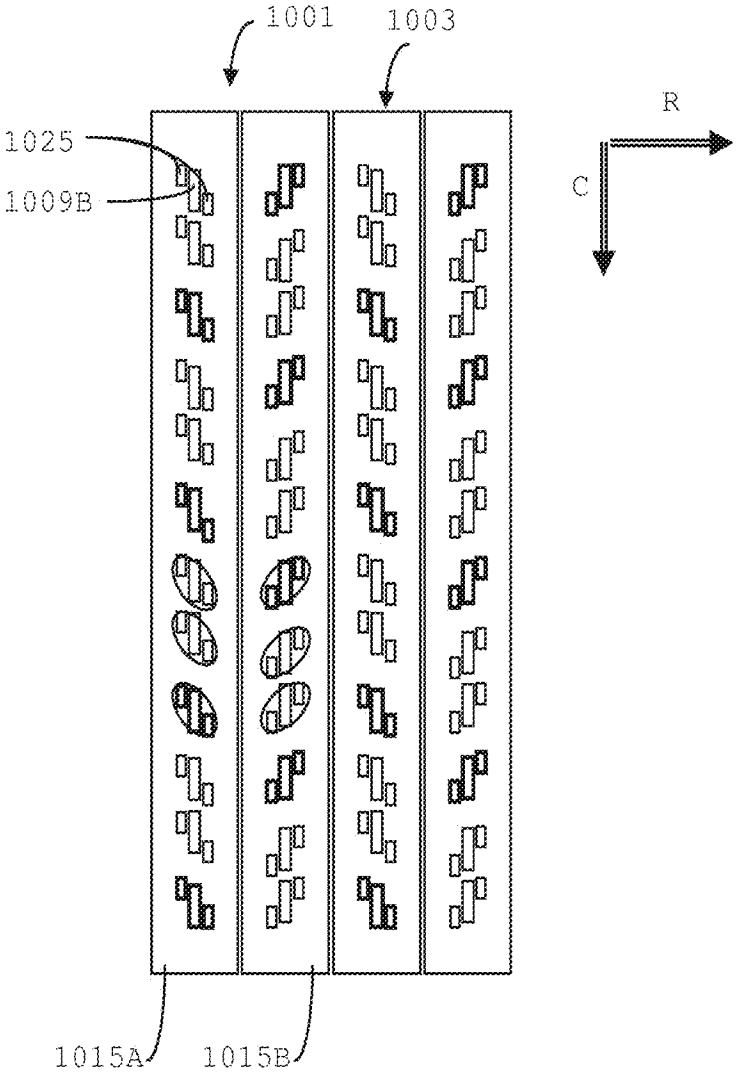
FIG. 14 shows a contact-counter contact arrangement in cross section.

FIG. 14 shows a cross sectional view of the mating portion MP in an embodiment of an assembly 1001 comprising a connector 1003 and a counterconnector 1009. The connector 1003 is a receptacle connector comprising leads 1005 with receptacle contacts 1003B of the tuning fork type having opposing arms 1025 and the counterconnector 1009 is a header 1009 comprising leads 1010 with blade contacts 1009B. FIG. 15 shows a side view of a blade contact 1009B received in a receptacle contact 1003B.

The connector 1003 of FIG. 14 comprises plural modules 1015. The header contacts 1009B are arranged according to the known arrangement of FIG. 3, providing straight columns of differential pairs SS having a pair direction P extending in the column direction C, being separated by ground contacts G and being staggered in the row direction R. Best seen in FIG. 14, the arms 1025 of the receptacle contact 1009B are arranged on opposite sides and towards opposite ends (top and bottom) of the contact blades 1009B. Thus, a conductive mass is formed by the contact portions having a generally elongated shape in cross section (see ellipses in FIG. 14). The orientation of the elongated shape is at an acute effective angle to the column direction C. In the connector 1003, adjacent columns 1015A, 1015B comprise receptacle contacts 1003B of which the arms 1025 are arranged opposite with respect to each other, so that the direction of elongation of the contacted contacts is generally opposite each other with respect to the column direction C. Such connector arrangement already provides improved over a known connector with a symmetric contact arrangement.

Figure 17:
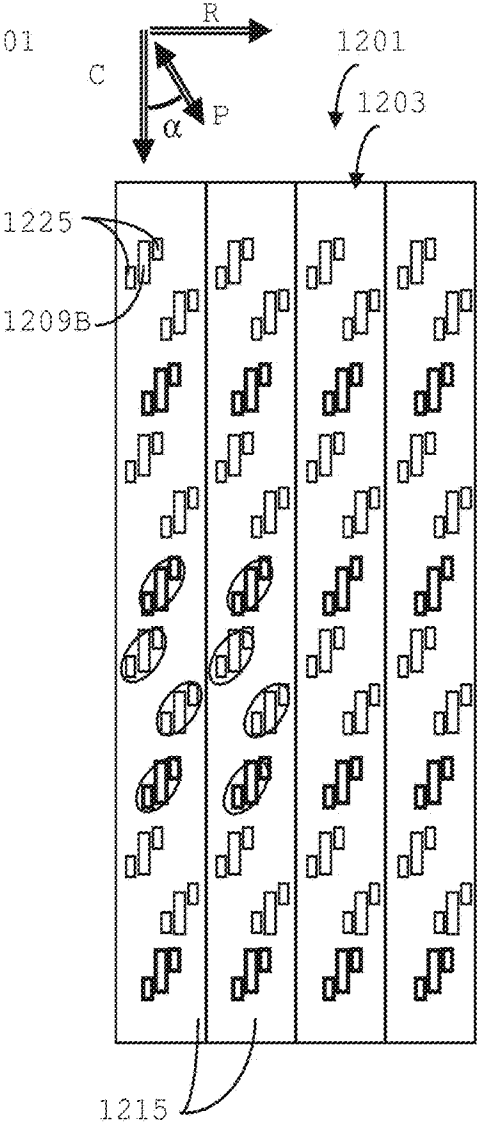
Figure 16:
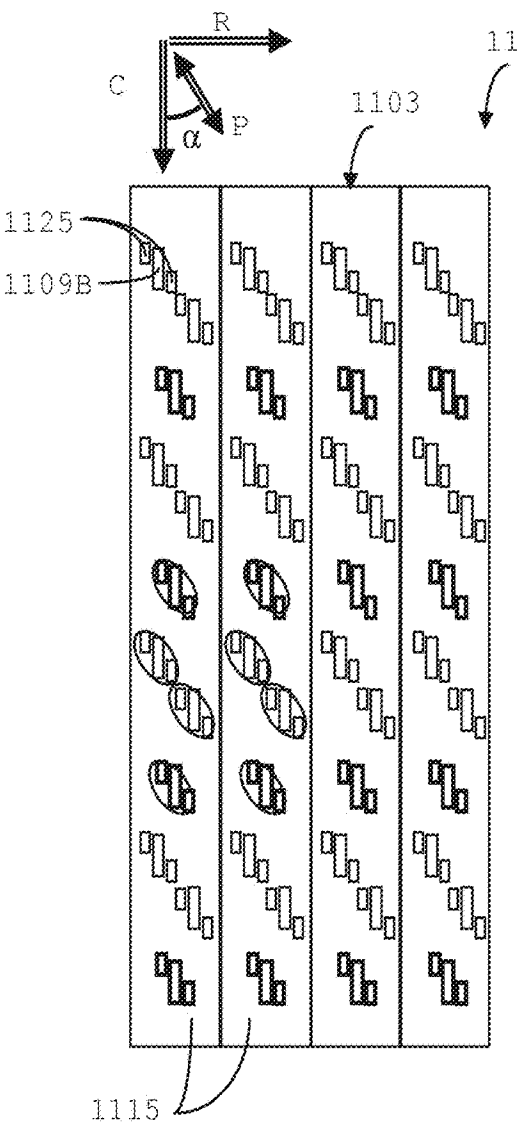

FIGS. 16 and 17 show views similar to FIG. 14 of embodiments comprising connectors according to FIG. 4 having substantially identical modules 1115 and 1215, respectively. In FIG. 16, the direction of elongation of the contact mass is substantially parallel to the pair direction P. In FIG. 17, the direction of elongation of the contact mass is substantially perpendicular to the pair direction P. In FIG. 16, interaction, e.g. edge coupling, between signal leads of one differential pair may be strong, whereas interaction between adjacent staggered differential pairs is significantly lower, e.g. due to the different distances of the leads within one differential pair relative to the leads of adjacent staggered differential pairs. Coupling between the lower signal lead of one pair and the upper lead of the adjacent pair is primarily capacitively. In FIG. 17, the leads of one differential pair exhibit primarily capacitive coupling, whereas interaction between the lower signal lead of one pair and the upper lead of the adjacent pair is primarily via edge type coupling. Thus, by selecting the shape and orientation of the contact mass, a desired coupling may be achieved, in addition to the staggering of the differential pairs in diagonal direction with respect to the column direction C.

Figure 18:
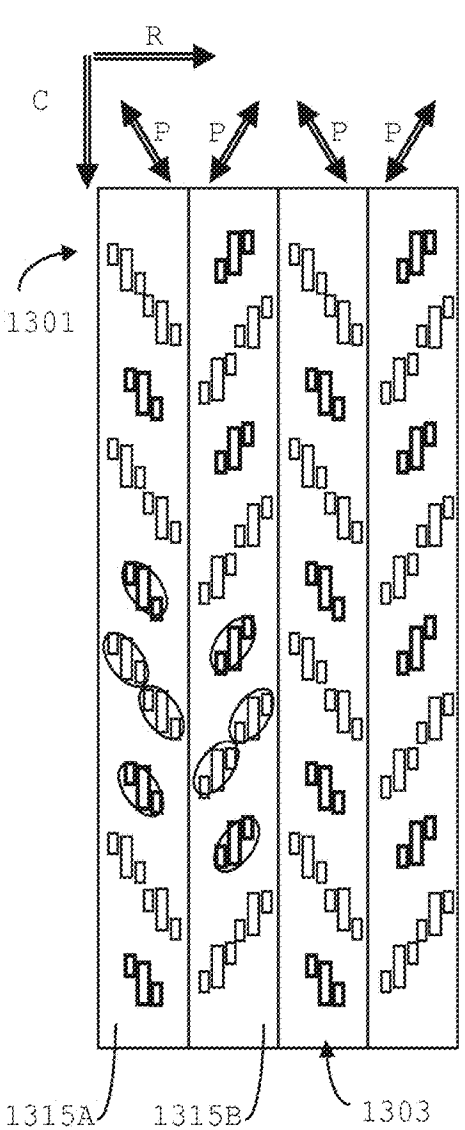
FIG. 16-18 show contact-counter contact arrangements in cross section.

FIG. 18 shows yet a further embodiment in a cross sectional view as in FIGS. 14, 15-17. Here, the connector 1303 comprises adjacent columns 1315A, 1315B which differ from each other in that in adjacent columns the pair direction P of the differential pairs SS is generally opposite to each other as indicated above each column. Within each column 1315A, 1315B, the elongated conductor mass provided by the contacts is generally along, here generally parallel to, the pair direction P.

Minimal inter-pair cross talk is achieved between a first differential pair SS1 having signal leads "a" and "b" and a second differential pair SS2 having signal leads "c" and "d" when the following equation is minimised, according to the well-known "QUADS"-principle:

$$CT(SS1.2)=\{CT(a.c)+CT(b.d)\}-\{CT(a.d)+CT(c.b)\},$$

wherein CT(SS1.2) is the cross talk noise strength between the pairs SS1 and SS2 and CT(a.b) . . . is the differential cross talk between the leads "a" and "b" etc.

It is presently believed that pair cross talk is minimised for a regular arrangement wherein the leads a-d are arranged on the corners of a rhombus, possibly a diamond, and preferably being shielded from further differential pairs SS by grounds along (extensions of) the sides, or (extensions of)

the main axes of the rhombus. The exact shape of the arrangement may depend on the shape of the conductors involved. The presented embodiments provide close approximations to such optimal arrangement, and generally provide reduced manufacturing costs.

The invention is not restricted to the above described embodiments which can be varied in a number of ways within the scope of the claims. For instance, the number of leads in the connector and details of their arrangement may vary. More or less shield may be provided. A modular connector may comprise different modules, including modules having more or less leads than an adjacent module or no leads at all, e.g. acting as a spacer or an insulator. Leads may comprise different contacts. In a footprint, a top and/or bottom row need not be straight.

In a connector the leads may be arranged as shown here only in a contact portion or a lead portion and not in one or more other portions, e.g. with the lead portions being arranged in a pair direction in parallel to the column direction C (cf. FIGS. 2 and 3) and with contact portions arranged with their pair direction rotated in an acute angle to the column direction C, e.g. as in FIG. 4, e.g. for reasons of adjusting impedance of the pair. However, it is presently considered beneficial if the differential pairs SS have an acute angle to the column direction substantially along the entire lengths of their respective signal leads.

Further, elements and aspects discussed for or in relation with a particular embodiment may be suitably combined with elements and aspects of other embodiments, unless explicitly stated otherwise.

What is claimed is:

1. A connector having a housing with a first surface and a second surface different from the first surface, wherein the connector is configured to mate with a mating connector with the first surface facing the mating connector, the connector comprising:

a plurality of first contact portions adjacent to the first surface, the plurality of first contact portions being arranged in a plurality of pairs, each pair being aligned in a pair direction, the plurality of pairs being arranged in columns extending parallel to each other in a column direction and being adjacent to each other in a row direction perpendicular to the column direction; and a plurality of second contact portions adjacent to the second surface, wherein:

the pair direction is at a first angle to the column direction, the first angle is greater than 0 degree and less than 90 degrees, and the plurality of second contact portions are configured to mount to a circuit board.

2. The connector of claim 1, comprising:

a plurality of leads, each lead comprising a respective first contact portion of the plurality of first contact portions, a respective second contact portion of the plurality of second contact portions, and a third portion that extends between the first contact portion and the second contact portion.

3. The connector of claim 2, wherein the third portions of the leads having first contact portions in a same pair are aligned in the column direction.

4. The connector of claim 2, wherein the third portions of the leads having first contact portions in a same pair are aligned in the pair direction.

5. The connector of claim 1, wherein the first angle is 45 degrees.

6. A connector module elongated in a column direction, comprising:

an insulative housing; and a plurality of leads held by the insulative housing, the plurality of leads being disposed in pairs, each lead comprising a mounting portion configured to mount to a circuit board, a contact portion opposite the mounting portion and configured to mate with a mating connector, and a third portion that extends between the mounting portion and the contact portion, wherein:

the contact portions of the leads in each pair are aligned in a respective pair direction that extends at an acute angle to the column direction.

7. The connector module of claim 6, wherein the respective pair directions of the pairs of the module are parallel.

8. The connector module of claim 6, wherein the connector module comprises a plurality of submodules comprising at least two leads of the plurality of leads.

9. The connector module of claim 6, wherein the pairs of leads are enclosed by grounds that are directly connected.

10. The connector module of claim 9, wherein the grounds comprise shields.

11. The connector module of claim 6, wherein the contact portions comprise two arms aligned in the respective pair direction.

12. The connector module of claim 6, wherein a contact portion comprises two arms aligned in a direction perpendicular to the pair direction.

13. The connector module of claim 6, wherein the contact portion comprises a blade.

14. The connector module of claim 6, wherein:

the insulative housing has a first surface, the column direction is a first column direction, the contact portions of the plurality of leads are adjacent to the first surface, the insulative housing comprises a second surface being elongated in a second column direction perpendicular to the first column direction, and the mounting portions of the plurality of leads are adjacent to the second surface.

15. The connector module of claim 14, wherein the mounting portions of the leads having contact portions in a same pair are aligned in the second column direction.

16. The connector module of claim 14, wherein:

the pair direction is a first pair direction, and the mounting portions of the leads having contact portions in the same pair are aligned in a second pair direction extending at an acute angle to the second column direction.

17. A connector comprising:

a plurality of modules separated in a row direction, each module being elongated in a column direction perpendicular to the row direction and comprising a plurality of leads, each lead comprising a mounting portion configured to mount to a circuit board, a contact portion opposite the mounting portion and configured to mate with a mating connector, and a third portion that extends between the mounting portion and the contact portion, wherein:

the contact portions of the plurality of leads are arranged in a plurality of pairs, the contact portions of the leads in a same pair are aligned in a pair direction, and the pair directions are at an acute angle to the column direction.

18. The connector of claim 17, wherein respective pair directions of the pairs of the module are parallel.

19. The connector of claim 17, wherein each of the plurality of modules comprises a plurality of submodules, each submodule comprising at least two leads of the plurality of leads.

20. The connector of claim 17, wherein the pairs of leads are enclosed by grounds that are directly connected.

21. The connector of claim 20, wherein the grounds comprise shields.

22. The connector of claim 17, wherein, within each module, the mounting portions of each pair separated by at least one ground mounting portion connected to a shield.

23. The connector of claim 22, wherein, the at least one ground mounting portion is closer to a periphery of the module than the mounting portions of the pairs.

24. The connector of claim 17, wherein the mounting portions of the leads having contact portions in the same pair are aligned in the column direction.

25. The connector of claim 17, wherein:

the plurality of modules are a first plurality of modules, the plurality of leads are a first plurality of leads, the pair direction is a first pair direction, the plurality of pairs of contact portions of the first plurality of modules are a first plurality of pairs of contact portions, and the connector comprises a second plurality of modules separated in the row direction, each module being elongated in the column direction and comprising a second plurality of leads, each lead comprising a mounting portion configured to mount to the circuit board, a contact portion opposite the mounting portion and configured to mate with the mating connector, and a third portion that extends between the mounting portion and the contact portion, wherein:

the contact portions of the second plurality of leads are arranged in a second plurality of pairs, and the contact portions of the leads in the same pair of the second plurality of pairs are aligned in a second pair direction opposite to the first pair direction.

26. The connector of claim 25, wherein the first plurality of modules and the second plurality of modules alternate in the row direction.

27. The connector of claim 25, wherein the contact portions of the second plurality of pairs are offset in the column direction from the contact portions of the first plurality of pairs.

28. The connector of claim 17, wherein the connector further comprises an insulative housing; and the plurality of modules are at least partially inserted into the insulative housing.

* * * * *